United States Patent [19]

Chaney et al.

[11] 4,189,645

[45] Feb. 19, 1980

[54] X-RAY MEASURING SYSTEM

[75] Inventors: Edward L. Chaney, Savannah, Ga.; Douglas C. Wiegman, La Grange Park, Ill.

[73] Assignee: Advanced Instrument Development, Inc., Melrose Park, Ill.

[21] Appl. No.: 919,758

[22] Filed: Jun. 28, 1978

[51] Int. Cl.[2] ..... H05G 1/26

[52] U.S. Cl. ..... 250/394; 250/252; 250/510

[58] Field of Search ..... 250/394, 252, 510

[56] References Cited

U.S. PATENT DOCUMENTS

| | | | |
|---|---|---|---|
| 2,258,593 | 10/1941 | Black | 250/252 |
| 3,562,525 | 2/1971 | Constantine et al. | 250/394 |
| 4,097,736 | 6/1978 | Jacobsen et al. | 250/252 |

OTHER PUBLICATIONS

Evans, R. D., "Gamma Rays," American *Institute of Physics Handbook*, 1963, pp. 81, 95 & 96.

*Primary Examiner*—Alfred E. Smith
*Assistant Examiner*—T. N. Grigsby
*Attorney, Agent, or Firm*—Leo J. Aubel

[57] ABSTRACT

A digital X-ray system for measuring X-ray beam quality such as the peak voltage applied to the X-ray tube and/or half value layer of the X-ray beam.

4 Claims, 6 Drawing Figures

X-RAY MEASURING SYSTEM

BACKGROUND OF THE INVENTION

There is a general need in the X-ray field to provide better radiation measurements. It has been previously found that measuring the radiation in terms of peak kVp provides one practical measurement of X-ray beam quality.

Existing methods for measuring the voltage applied to an X-ray tube may be classified as either direct or indirect methods. Instruments for providing direct method measurements require electrical connections to the X-ray tube, to the high voltage transformer, or to other components in the high voltage circuit. The direct method necessitates alteration of the high voltage circuits; and, the instruments utilized with direct measurement methods are relatively expensive. Indirect methods, instead of making connection in the high voltage circuit, rely on measurement of signals that are related in a known fashion to the voltage applied to the X-ray tube. A number of indirect methods are known and used and most involve measurements of the X-ray beam emanating from the tube. Known indirect methods of voltage measurement require some user interpretation of data; some require special training and some methods require sophisticated and/or expensive equipment.

The invention discloses a unique indirect method of measuring the voltage applied to an X-ray tube which overcomes various disadvantages associated with existing indirect methods for measuring the voltage applied to an X-ray tube. The present invention provides instantaneous readout of voltage, utilizing compact, relatively inexpensive equipment which can be readily operated without requiring specialized training of the operator. Further the present invention determines the voltage from one exposure from the X-ray tube. Another technique for measuring X-ray beam quality which has found general acceptance is the measurement of the so called half-value thickness of half-values layer (HVL) of an X-ray beam. An existing technique for measuring HVL relies on having a single dosimeter, multiple filters and multiple X-ray exposures. Generally, a single exposure without added filtration is first made to obtain a reference exposure value. Additional exposures are then made, each exposure being made with a different thickness of filtration added between the X-ray tube and dosimeter until more than 50% of the beam is attenuated by the filter material. X-ray radiation is then plotted as a function of added filtration. The filtration required to reduce the beam by 50% of filtration is defined to be the half-value layer.

The present invention generally utilizes the principal of measuring beam quality by absorption in two filters. An article "Inferential kilovoltmeter" (subtitled "Measuring X-ray Kilovoltage by Absorption in Two Filters") by Robert R. Newell, M.D., and George C. Henry, M.D., presented as an Exhibit at the Thirty-Ninth Annual Meeting of the Radiological Society of North America, Chicago, Ill., Dec. 13–18, 1953 describes basic principals of the method. The article entitled "A Simple Method For Measuring Peak Voltage in Diagnostic Roentgen Equipment" by Russell H. Morgan, M.D., in the AMERICAN JOURNAL OF ROENTGENOLOGY AND RADIUM THERAPY, Vol. 1.11., No. 2, Aug. 1944 also describes a method for measuring kVp using two filters.

However, while general methods for measuring beam quality by utilizing absorption in two filters have been known, the present invention specifically provides a practical system for providing an accurate measurement of the X-ray beam by absorption techniques. The present invention also refines and quantitates the technique by deriving and elucidating relationships between kVp and detector signals.

SUMMARY OF THE INVENTION

The invention discloses an X-radiation measuring instrument capable of receiving the radiation dose from an installed X-ray tube and measuring the quality of the X-ray beams in terms of peak kilovoltage, half value layer, exposure, time, radiation rate, and radiation dose. The instrument, through proper selection of filtration, measures the transmissions of X-radiation through each of two filters and computes the unique ratio of the signals, converts the ratio to a peak kilovoltage and displays result in digital form as peak kilovoltage kVp. Through selection of other filtration the half-value layer (HVL) is similarly computed and displayed. The X-radiation exposure is sensed and the length of time of exposure is determined and processed in a microprocessor and displayed. The quantity and rate of radiation is thus measured and digitally displayed.

DESCRIPTION OF THE DRAWINGS

Further objects and advantages of the invention will be readily apparent from the following detailed description of preferred embodiments, when considered in conjunction with the drawings, wherein.

THEORETICAL CONSIDERATIONS

A basic assumption in the construction and operation of the inventive system is that X-ray beams generated by different diagnostic X-ray systems operated under identical conditions, such as with the same waveform and peak kilovoltage (kVp) applied to the diagnostic X-ray tube, exhibit essentially identical beam qualities after heavy filtration.

We have found that if an X-ray beam is passed through filters or absorbers, such as selected thicknesses of copper, the following formula gives the relation to the applied peak kilovoltage.

$$kVp=[(C_1\Delta X)/(\log R)]1/C_2$$

Where ΔX is the difference in the filter thicknesses of two filters or absorbers and R is equal to the ratio of two electrical signals generated by respective detectors receiving the X-ray beams through the filters. The terms $C_1$ and $C_2$ are constants which depend on filter composition, filter thickness, detection geometry, detector characteristics, kVp waveform and kVp range. Accordingly, if filter composition and thickness, detection geometry, and detector characteristics are fixed, the constants $C_1$ and $C_2$ depend only on kVp waveform and range. The radiation reaching each of the two detectors varies in intensity and hence the detector output signals should be linearly dependent on intensity. Silicon detectors are utilized in the present system since these type detectors have an output proportional to intensity under appropriate operating conditions.

Ideally each of the detectors should sample the same point in the radiation field and respond to the same beams since if the detectors are positioned to sample different points of the X-ray field, marked differences in output may result; thus special precautions in positioning the detector must be taken to minimize these differences. Preferably and as utilized in the embodiment of the invention of the drawings herein the detectors sample essentially the same point on the radiation field to eliminate these differences.

A preferred embodiment of the inventive system was adjusted to provide an output voltage according to the foregoing equation such that;

$$kVp=[(C_1\Delta X)/(\log R)]1/C_2=[0.124/\log R]0.412$$

Likewise the following relation was found for obtaining the half value layer (HVL) with the present invention.

$$HVL=0.693\Delta X/\log R$$

As above, ΔX is the difference in thickness between the two filters and R is the ratio of the signal output from the detectors.

The electronic circuit disclosed, produces a signal that quite accurately processed the signal in accordance with the selected equations; hence the accuracy of the present system is related to the applicability of the equations. Note also that the use of two detectors to detect X-rays simultaneously during the same exposure removes possible differences associated with sequential exposures.

DESCRIPTION OF PREFERRED EMBODIMENT

Figure 1:
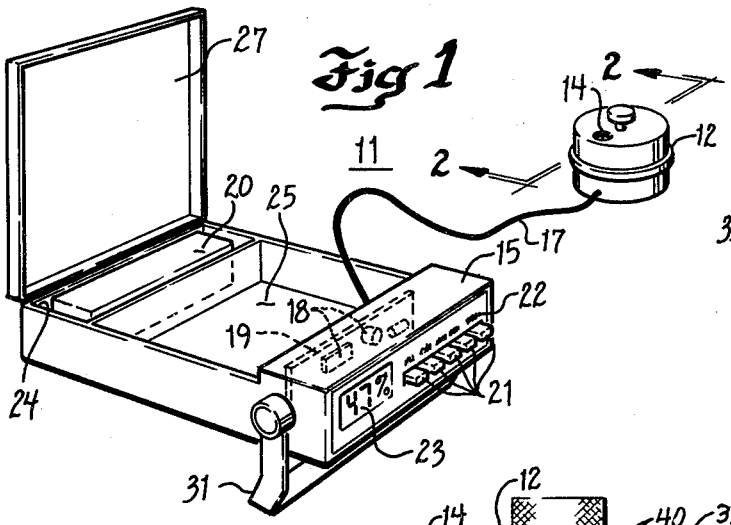
FIG. 1 shows the inventive system includng the console with the control panel, the electronic circuitry, and the filter module.

Referring to FIG. 1, the inventive system 11 for measuring X-ray beam quality comprises a filter module 12 which is connected to the console 15 by a suitable electrical connector 17. Console 15 includes the electronic circuitry 18 on suitable printed circuit (PC) boards generally labeled 19. The electronic circuitry 18 on PC boards 19 is controlled by suitable push button switches 21 mounted on a front panel 22. A display terminal 23 is also positioned on panel 22. The console 15 includes a well or recess 25 for housing and storing detector module 12 and connector 17. A battery 20 is positioned in a well or compartment 24 of console 15. A cover 27 closes over the battery and module wells of console 15. A gimbal 31 attached to the console enables positioning of the console on a table or desk for convenient visual orientation of the panel 22 for the operator.

Figure 2:
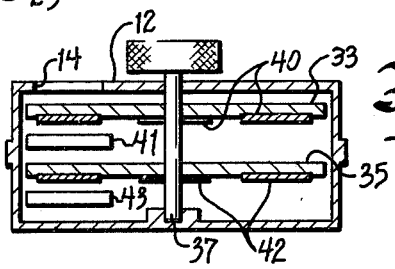
FIG. 2 is a cross sectional view taken along the lines 2—2 of FIG. 1 to show the relative positioning of the detectors and the filter wheels in the filter module.

Refer now to FIG. 2 which shows a cross sectional view taken along the lines 2—2 of FIG. 1 to better illustrate the structure of the filter module 12. Module 12 includes a pair of axially spaced filter carrying wheels or supports 33 and 35. The wheels 33 and 35 are mounted on a rotatable rod 37 which enables the wheels to be selectively moved or rotated to a desired position.

A pair of X-ray beam detectors 41 and 43 are mounted in module 12, preferably in vertical alignment, that is, one above the other, in position such as shown in FIG. 2, in order to sense or sample the same X-ray beams, for purposes to be explained. X-ray beam detector 41 and 43 are electrically connected in an electronic circuit (refer briefly to FIG. 6) and each generates an electrical signal in response to the X-ray beams to which it is exposed.

Figure 4:
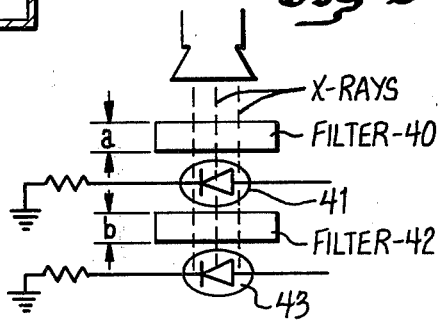
FIG. 4 shows a sketch useful in explaining the concept of the filter system of the invention.

When the detectors are in a position as indicated in FIGS. 2 and 4 and are exposed to the X-rays, the X-ray beam which is effective on detector 41 will be filtered through a filter 40 of thickness a. The X-ray beam which is effective on detector 43 will have been filtered through the filter 40 of thickness a and a second filter 42 of thickness b. Hence the detectors 41 and 43 produce electronic signals of different amplitudes.

Figure 3:
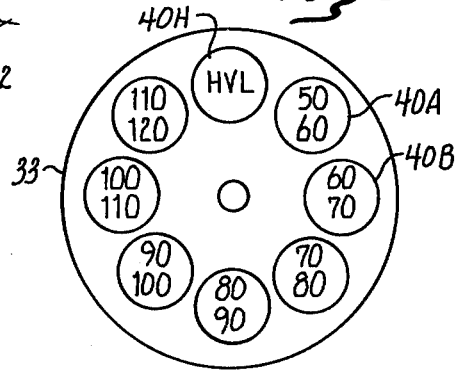
FIG. 3 shows a top view of a filter wheel showing a number of filters contained therein and indicating the relative transmission characteristics of the various filters.

Referring to FIG. 3, the filter wheel 33 of filter module 12 includes one inch knockouts, (recesses around its periphery). Filter wheel 35, see also FIG. 2, is similar to wheel 33. Copper discs or discs of other suitable composition of varying thickness are mounted in seven of the eight knockouts. Copper is used in the preferred because copper is readily available, relatively inexpensive, easily machined to correct thicknesses. Each of the filters are designated a particular kVp range as indicated. The eighth knockout is filled with an aluminum filter for HVL measurements.

Figure 5:
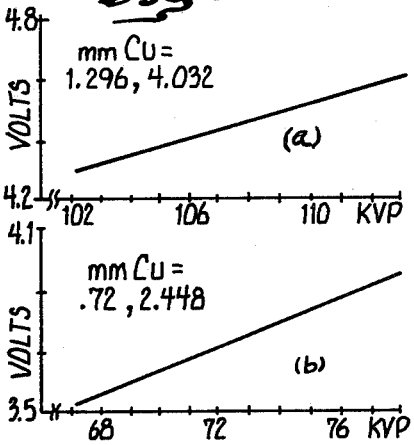
FIG. 5 is a graph showing the voltage output plotted with respect to the peak kilovoltage (kVp) applied when using two different pairs of copper filters; and, FIG. 6 is a block diagram of the electronic circuit used to process the signals resulting from X-ray beam exposures to provide an output display.

Assume in FIG. 3 that the kVp is in the 70 to 80 kVp range. Accordingly the rod 37 would be rotated to position the filters labeled 70 to 80 under the aperture 14 of module 12. The filters labeled 70 to 80, and of the thickness indicated, would be utilized in this measurement and an output would be obtained such as indicated in FIG. 5(a). Likewise still referring to FIG. 5, if the kVp is in the 100 to 110 kVp range the filters labeled 100 to 110 would be utilized and an output would be obtained such as indicated in FIG. 5(b).

Note that the microprocessor can be conveniently programmed to process the equations for each kVp range, each with an optimal or unique ΔX.

Figure 6:
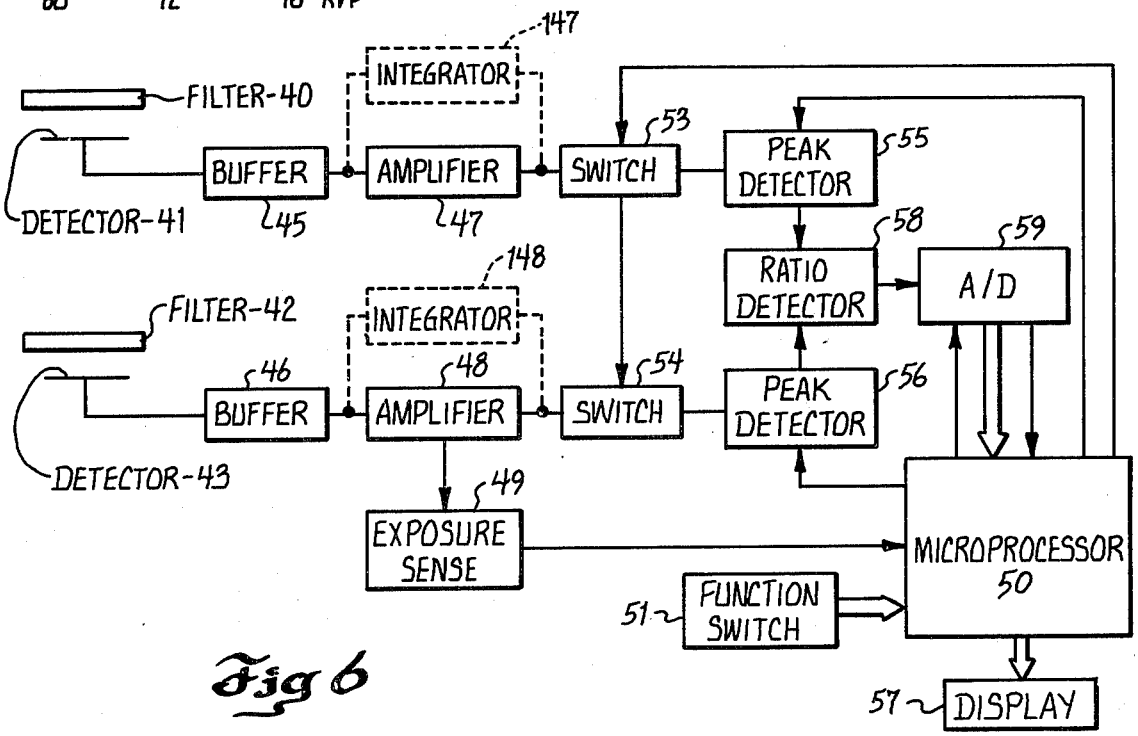

Refer now to FIG. 6, the electronic signals developed by detectors 41 and 43 are respectively buffered as at 45 and 46 and amplified as at 47 and 48. A signal from amplifier 48 is coupled to an exposure sense circuit 49 which in turn provides an initiating signal to a microprocessor 50. Electronic switches 53 and 54 are concurrently activated by microprocessor 50 to couple the signals from amplifiers 47 and 48 to peak detectors 55 and 56 which have also received an input from the microprocessor 50.

Integrators 147 and 148 may be substituted in the circuit for amplifiers 47 and 48, respectively, if the signal outputs from detectors 41 and 43 are not as strong as desired. As is known integrators 147 and 148 would integrate the signals over time to build up the signals for further processing.

The output of peak detectors 55 and 56 are combined and processed in a ratio detector 58. The output of the ratio detector is coupled through an analog to digital convertor 59 to the microprocessor 50. Microprocessor 50 is programmed to process the signals in accordance with the equations cited above. Function switch 51 selects the function to be obtained.

Dependent on the function selected, the display 57 may provide an indication of the applied kVp in volts, an indication of the half value layer (HVL) in millimeters of thickness, an indication of the exposure rate in Roentgens per minute, and an indication of the exposure time up to five seconds in 10 millisecond increments.

While the invention has been particularly shown and described with reference to preferred embodiments thereof, it will be understood by those skilled in the art that various changes in form and details may be made therein without departing from the spirit and scope of the invention.

We claim:

1. A system for providing measurements of X-ray beam quality including that of determining the half value layer of the X-ray beam applied to an associated X-ray tube, first and second filter means each of selected thickness and composition for filtering said X-ray beams, first and second detector means respectively associated with said first and second filter means, said first filter means positioned intermediate the source of said beams and said first detector to filter the beams before the beams impinge on said first detector, said second filter means positioned intermediate the source of said beams and said second detector to filter the beams before the beams impinge on said second detector, said filter means and detector means mounted in essentially series alignment with the source of X-ray beams in order that the detector means sample essentially the same X-ray beams, the total thickness of the filter means between the source and said first detector being the thickness of the first filter means, and the total thickness of the filter means between the source and said second detector being the thickness of the first filter means plus the thickness of the second filter means, each of said detector means providing a respective electrical output responsive to the beams impinging thereof, means for obtaining the ratio of the electrical outputs from said detectors in accordance with the relation $$HVL = 0.693\Delta X/\log R$$

where $\Delta X$ is the difference in effective filter thickness between the first and second detectors and R is equal to the ratio of the outputs from the detectors, and means for processing and displaying a signal of said ratio.

2. A system for providing measurements of X-ray beam quality including that of determining the peak kilovoltage (kVp) applied to an associated X-ray tube, first and second filter means each of selected thickness and composition for filtering said X-ray beams, first and second detector means respectively associated with said first and second filter means, said first filter means positioned intermediate the source of said beams and said first detector to filter the beams before the beams impinge on said first detector, said second filter means positioned intermediate the source of said beams and said second detector to filter the beams before the beams impinge on said second detector, said filter means and detector means mounted in essentially series alignment with the source of X-ray beams in order that the detector means sample essentially the same X-ray beams, the total thickness of the filter means between the source and said first detector being the thickness of the first filter means, and the total thickness of the filter means between the source and said second detector being the thickness of the first filter means plus the thickness of the second filter means, each of said detector means providing a respective electrical output responsive to the beams impinging thereon, means for obtaining the ratio of the electrical outputs from said detectors in accordance with the relation $$kVp = [(C_1\Delta X)/(\log R)]1/C_2$$

where $C_1$ and $C_2$ are selected constants, $\Delta X$ is the difference in effective filter thickness between the first and second detectors, and means for processing and displaying a signal of said ratio in accordance with a preset relation dependent on the respective thicknesses of said filter means.

3. A system as in claim 2 including a housing containing said filter means, said housing forming an X-ray shield for said filter means and having an aperture for selectively admitting X-ray beams to impinge on selected filter means, said filter means comprising copper discs, mounting means for mounting said first and second filter means as pairs and in alignment to receive substantially the same X-ray beams, said mounting means being movable to selectively position a pair of said filter means adjacent said aperture to receive the X-ray beams.

4. A system as in claim 3 wherein said mounting means comprising a pair of wheels each having a plurality of apertures each receiving a copper disc.

* * * * *